US008373529B2

(12) United States Patent
Hurst et al.

(10) Patent No.: US 8,373,529 B2
(45) Date of Patent: Feb. 12, 2013

(54) AMORPHOUS METAL CONTINUOUS FLUX PATH TRANSFORMER AND METHOD OF MANUFACTURE

(75) Inventors: John Shirley Hurst, Indian Trail, NC (US); Jurgen Klaus Vollrath, Indian Trail, NC (US)

(73) Assignee: Hexaformer AB, Upplands Väsby (SE)

( * ) Notice: Subject to any disclaimer, the term of this patent is extended or adjusted under 35 U.S.C. 154(b) by 0 days.

(21) Appl. No.: 12/657,932

(22) Filed: Jan. 29, 2010

(65) Prior Publication Data

US 2010/0194515 A1 Aug. 5, 2010

Related U.S. Application Data

(60) Provisional application No. 61/206,907, filed on Feb. 5, 2009, provisional application No. 61/212,660, filed on Apr. 14, 2009.

(51) Int. Cl.
*H01F 30/12* (2006.01)
*H01F 27/24* (2006.01)

(52) U.S. Cl. ..... 336/5; 336/212

(58) Field of Classification Search ..... 336/5, 212
See application file for complete search history.

(56) References Cited

U.S. PATENT DOCUMENTS

| | | | | |
|---|---|---|---|---|
| 2,544,871 | A | 3/1951 | Wiegand | |
| 3,195,090 | A * | 7/1965 | Burkhardt et al. | 336/218 |
| 3,297,970 | A | 1/1967 | Jones | |
| 4,345,232 | A * | 8/1982 | DeLaurentis | 336/210 |
| 4,506,248 | A | 3/1985 | Lin | |
| 4,520,335 | A * | 5/1985 | Rauch et al. | 336/212 |
| 4,557,039 | A | 12/1985 | Manderson | |
| 4,565,746 | A | 1/1986 | Hayase | |
| 4,595,843 | A | 6/1986 | Delvecchio et al. | |
| 4,668,931 | A * | 5/1987 | Boenitz | 336/212 |
| 6,285,014 | B1 | 9/2001 | Beck et al. | |
| 6,668,444 | B2 | 12/2003 | Ngo et al. | |
| 6,683,524 | B1 | 1/2004 | Hoglund | |
| 6,809,620 | B2 * | 10/2004 | Hoglund | 336/5 |
| 6,844,799 | B2 | 1/2005 | Attarian | |
| 6,880,228 | B2 * | 4/2005 | Bolotinsky et al. | 29/596 |
| 2002/0157239 | A1 * | 10/2002 | Ngo et al. | 29/606 |
| 2004/0085174 | A1 | 5/2004 | Decristofaro et al. | |
| 2004/0150498 | A1 * | 8/2004 | Marusinec et al. | 336/5 |
| 2005/0237146 | A1 | 10/2005 | Hirzel | |
| 2006/0066433 | A1 * | 3/2006 | Decristofaro et al. | 336/212 |

FOREIGN PATENT DOCUMENTS

| | | | |
|---|---|---|---|
| EP | 151048 | A1 * | 8/1985 |
| JP | 05029157 | A * | 2/1993 |

* cited by examiner

*Primary Examiner* — Mohamad Musleh
*Assistant Examiner* — Tsz Chan
(74) *Attorney, Agent, or Firm* — Potomac Patent Group PLLC

(57) ABSTRACT

In a three phase transformer core, amorphous metal strips are wound into rings that are combined into frames and assembled to define cores with leg cross sections that have more than 4 sides to facilitate winding transformer windings onto the legs using winding tubes. The amorphous metal layers are secured relative to one another and the core made more rigid using resin, silicon steel layers included in the amorphous metal core, or by using strapping or tying devices.

9 Claims, 9 Drawing Sheets

AMORPHOUS METAL CONTINUOUS FLUX PATH TRANSFORMER AND METHOD OF MANUFACTURE

This application is a non-provisional application that claims priority from U.S. provisional patent applications 61/206,907 filed Feb. 5, 2009 to John Hurst and 61/212,660 filed Apr. 14, 2009 to John Hurst et al.

FIELD OF THE INVENTION

The invention relates to transformers. In particular it relates to transformers made of an amorphous metal.

BACKGROUND OF THE INVENTION

Transformers operate on the principle that when two wires are arranged in proximity to each other and an alternating current is passed through one of the wires, an alternating current is induced in the other wire by an effect known as electromagnetic induction. By winding the wires into coils and placing the coils along a common axis the amount of electromagnetic coupling and thus the amount of induced current will be increased over straight, parallel wires. The coupling is increased yet further by winding the two coils on top of each other. The coupling can also be increased by placing a ferromagnetic substance, referred to as a core, within the coils.

Over time cores have been improved to minimize losses. In the case of low frequency applications such as power transformers used in the national grid (typically 50-60 Hz) in order to reduce eddy currents in the core, which cause heat losses, the cores are typically implemented in layers.

In the United States electrical power intended for commercial and industrial applications is produced as three phase. For home use the power is typically also generated as three phase but in most applications only one phase is used, the other phases being used for other homes.

As mentioned above, one important issue in transformer design is energy loss, and in the energy distribution industry the opportunities for energy loss are numerous. From the generating station, electric power is transmitted at high voltages along power lines using step-up transformers, also referred to herein as generation transformers. Various stages of step-down transformers, including substation transformers and distribution transformers are then used to "step down" the voltage to usable levels, e.g. 110-240 volts, for residential and industrial users. An estimated 10% of all electricity generated is lost because of distribution inefficiency. Two types of losses can be identified in transformers: load losses or coil losses that vary depending on transformer loading, and no-load losses or core losses that occur in the magnetic cores and take place over the life of the transformer regardless of the load. No-load losses represent a significant portion of the energy lost during power distribution. It is therefore not surprising that much work has gone into improving transformer cores.

For ease of understanding the various issues involved in transformer manufacture, two types of transformers should be distinguished: single phase, and three phase transformers.

In the case of single phase transformers, a single primary winding shares its electromagnetic flux with a single secondary winding. In order to improve flux flow, ferromagnetic cores have commonly been used to provide a common flux path for the two coils. One single phase core configuration is the toroidal transformer core 100 shown in FIG. 1. However, it will be appreciated that once the core is formed, in order to get the copper windings for the first coil 102 onto the core

100, a coil bobbin that is small enough to pass through the window 106 of the core has to be passed repeatedly through the window in order to wind the coil onto the core. In the case of the second winding 106 the bobbin has to be small enough to accommodate the reduced window size caused by the first winding. An alternative approach is to form the windings separately and cut the core in order to slip the windings onto the core. The cutting of the core however causes numerous breaks in the continuity of the core material, which leads to interference in the magnetic flux path and core losses. This is typically addressed by subsequently annealing the core to minimize these losses, as is discussed in greater detail below.

In three phase power the primary and secondary windings are either connected as a delta connection (FIG. 2) or a wye connection (FIG. 3).

A variety of core configurations have been developed over the years, including the E-core, as shown in FIG. 4, which includes a three-legged section 400 in the form of an E and a bar section 402 that closes the open side of the E-section. The E includes a middle leg 404, a top leg 406, and a bottom leg 408 extending from a yoke 410.

E-cores are universally used at 50 and 60 Hz and implemented in either shell-wound configuration (primary and secondary windings wound on top of each other around the middle bar or leg 404) or core-wound configuration (the primary and secondary windings are wound around the top leg 406 and bottom leg 408, respectively). In order to reduce eddy current losses the core is typically made up of thin layers of metal stacked on top of one another. For instance in the E-core the yoke 410, legs 404, 406, 408 and bar 402 are cut to length and to the appropriate shape from a strip of metal that is typically delivered in the form of a reel. The various cut sections are then stacked on top of one another in layers to form the desired configuration. At the corners various overlapping layer configurations have been developed, e.g., butt lap and step lap configurations to minimize the losses caused by the flux direction change at the corners.

One family of transformers that has evolved to avoid some of the problems associated with core losses at the corners of the core, involves what will be referred to as wound transformer cores. Instead of stacking layers of metal on top of each other to define the leg and yoke sections of the core, the core is formed by winding several multiple-layer rings of metal and combining the rings in different configurations to define a core Large single phase wound cores, and some three phase wound cores have been produced by Cogent Power and Metglas. The three phase cores made by Cogent Power, Inc of Burlington, Ontario include a similar design to that of Metglas, involving a 5-leg design comprising 4 rounded-square, annular or toroidal core elements arranged side by side as shown in FIG. 5. Another Cogent Power three phase arrangement makes use of three rounded-rectangular configuration cores with one large toroidal core forming the outer perimeter of the structure and two smaller toroidal cores arranged inside the larger one as shown in FIG. 6. These cores have the advantage of avoiding the overlapping core layers at the corners and thereby provide a continuous flux path prior to the coils being place (or landed) on the core. However, in order to place the copper windings or coils onto the core legs, these constructions commonly involve cutting the core material and rejoining the cut strips after the installation of the coils. The cutting and rejoining process again creates breaks in the core layers that significantly increase the core losses Yet another configuration is discussed in U.S. Pat. No. 6,668,444 to Ngo, filed Apr. 25, 2001 and issued Dec. 30, 2003. This is shown in FIG. 7, and involves cutting a strip of core material into strip segments, which are then assembled into groups 700, which are in turn arranged in staggered configuration to define a step lapped packet 702, whereafter multiple step-lapped packets are arranged on top of one another and connected to adjacent sets of step-lapped packets. It will be appreciated that although this core construction makes use of layers having a wound configuration that avoids sharp corners with the breaks in the core layers, it nevertheless typically involves hundreds and even thousands of breaks in the amorphous metal strip causing numerous interruptions in the flux path, which leads to losses in the core.

This has led to the development of core configurations that are wound but avoid the need to cut the core legs in order to place the transformer coils on the legs. These uncut, wound cores will, for purposes of this application, be defined as continuous flux path transformer cores since they avoid sudden direction changes and breaks in the core layers. In particular, in order to achieve this continuous flux path configuration, the transformer coils need to be wound onto the legs of the core instead of being wound separately and then placed on the legs. This can be accomplished in one of two ways. One approach is by the use of a bobbin passed through the window of the transformer core. As mentioned above, the use of a bobbin is, however, very limited by design constraints since it requires enough window space between the core legs to allow the bobbin to pass through the window even when the other legs are already wound with coils that have the effect of reducing the window size.

The alternative approach, and the one that is the basis of the present invention involves the use of winding tubes that are attached around the legs in a rotatable fashion and thus allow coils to be wound onto the legs by rotating the tubes. This, however, requires leg cross-sections that are substantially round in order to minimize the air gap between the core legs and the coil windings. For purposes of this application, the term substantially round cross-section will refer to a multi-sided cross-section that has more than 4 sides (more sides than a simple square or rectangle) to increase the fill factor of core material within the circle defined by the coil windings that are wound around the core leg and thus provide a higher fill factor than that provided by a square or rectangular cross-sectional core leg. In order to achieve such a non-rectangular cross section, the cores are built up of a complex set of beveled rings, which involves a process that is significantly more complex and requires more manipulation than is the case with a simple set of toroidal core elements.

One such core configuration, is the hexaformer core, which has been publicly available since Mar. 16, 2000 and is shown in FIG. 8. This core configuration is described in greater detail in U.S. patent application Ser. No. 09/623,285 (U.S. Pat. No. 6,683,524 to Hoglund, filed as a PCT application on Sep. 2, 1999). The hexaformer core defines legs with a hexagonal cross-section, which is sufficiently round to permit winding coils on the legs using winding tubes while maintaining a high fill factor (core material in the circle defined by the coils that are wound on the winding tube). Another continuous flux path core configurations that permits winding on the leg is the Wiegand configuration as described in U.S. Pat. No. 2,544,871 to Wiegand, filed Apr. 24, 1947 and issued Mar. 13, 1951, which makes use of parallel sided strips of wound material. Two other continuous flux path cores that allow winding on the leg are the Haihong core produced by Haihong in China, and the Manderson core described in U.S. Pat. No. 4,557,039 to Manderson, filed Jul. 20, 1982 and issued Dec. 10, 1985, which differ from the hexaformer core and the Wiegand core in that they make use of wound material with tapered sides.

In an alternative approach, in order to reduce core losses, the use of an amorphous metal alloy as a core material has found a significant amount of interest. However, due to the nature of amorphous metal, which will be discussed in greater detail below, cores made from amorphous metal have maintained a simple configuration in which the legs of the core have a simple square or rectangular cross section. One such amorphous metal transformer is described in U.S. Pat. No. 6,844,799 to Attarian which describes the use of amorphous metal laminations. One type of amorphous metal described in Attarian is the use of a cobalt-based (Co-based) amorphous metallic alloy, or a cobalt-iron (CoFe) alloy that may also include vanadium (e.g., CoFe—V having 49% Co, 49% Fe, and 2% Vanadium (V)). As described in the Attarian patent, amorphous metallic alloys are produced by rapid solidification of molten metal and exhibit excellent magnetic properties as described in the article entitled "Amorphous Metallic Alloys" in the undated publication entitled "AMOS® Amorphous Cores" by AMOTECH (Advanced Material On TECHnology).

However, as mentioned above, amorphous metal has physical characteristics that make it much more difficult to work with than silicon steel. Amorphous is by its nature a very thin, slippery material that lacks rigidity and therefore is extremely floppy and difficult to handle. The layers of amorphous metal used to build up a core are typically to significantly thinner than silicon steel layers used in silicon steel transformers. Amorphous metal layers have a thickness of the order of only 0.001 inch (0.0254 mm) since the production of amorphous metal requires the amorphous alloy to be cooled quickly in order to avoid grain structure from forming and thus requires the alloy to be manufactured very thinly.

Accordingly, the layers are of the order of 8 to 12 times thinner than any silicon steel conventionally used in transformers, and are very slippery. Even when built up as hundreds of layers of amorphous material, it remains floppy and has none of the self-supporting rigidity found in silicon steel built up to a similar thickness. As a result amorphous metal transformer cores have in the past been largely limited to single phase transformers with a simple C-shaped core or annular core, which is typically shaped like a square doughnut with rounded corners such as those described on the Metglas Website www.metglas.com, or as crude three phase cores involving multiple annular cores arranged side by side to define a 5-legged or 3-legged design. These cores have legs with a square or rectangular cross-section, and are thus not suitable for winding transformer coils onto the legs by means of coil tubes since the fill factor between the coils and the core would be too low.

The Ngo core design described above has also been implemented using amorphous metal but again the leg cross section is a simple square or rectangle and is therefore not suitable for winding transformer coils on the legs by means of winding tubes.

In order to avoid the losses and limit the need for annealing typically involved with cut cores, the present invention provides for a continuous flux path three phase core implemented at least in part from amorphous metal.

SUMMARY OF THE INVENTION

According to the invention, there is provided a three phase transformer core comprising a continuous flux path core configuration, wherein at least part of the core includes amorphous metal.

For purposes of this application, the term continuous flux path core comprises a wound core that is not cut in order to place the transformer coils on the core. The core may be formed partly from amorphous metal and partly from silicon steel, which may be either grain-oriented silicon steel or non-grain oriented silicon steel. For instance, a few layers, e.g. two layers of silicon steel may be used to form the inner layers of the core, followed by several hundred or several thousand layers of amorphous metal, optionally followed by a few layers of silicon steel in the middle of the core, followed by another few thousand amorphous metal layers, and finally forming a few layers of silicon steel to form the outer layers of the core. At least the inner layers of silicon steel may be treated for greater rigidity, e.g., by varnishing and baking, to define an inner tube for supporting the amorphous metal. For purposes of this application a core that includes both amorphous metal and silicon steel will be referred to as a hybrid core. A hybrid continuous flux path transformer core that includes multiple rings, may as one aspect of the invention be constructed with some rings wound entirely or predominantly from amorphous metal and some rings wound from silicon steel. Insofar as the silicon steel layers (or layers of other support material having greater rigidity than amorphous metal) are interspersed within the amorphous layers or wound on the inside or outside of the amorphous ring to provide the amorphous ring with greater structural integrity, such support layers will be referred to herein as forming an internal skeleton.

Instead of using layers of silicon steel within an amorphous metal ring in order to support the amorphous layers, or in addition to such silicon steel layers, at least some of the layers of amorphous metal may be secured relative to each other by making use of a polymer, which may include at least one of resin between the layers, e.g., applied electrostatically as a powder or mist. Polymer may also be applied to the outer surface of the core e.g., using banding straps (resin impregnated straps that are also referred to as stator banding) or as a liquid or paste that is brushed or sprayed on to cover the core with a polymer layer or shell. Fiberglass material e.g. fiberglass chop may be included in the resin that is applied to the outer surface of the core, or may subsequently be applied to the resin on the core surface prior to the resin being fully cured. Any outer shell such as a resin layer or coating formed around the outer surface of the core will for purposes of this application also be referred to as an external skeleton.

The continuous flux path core may comprise three frames, each including multiple rings or loops or windings (e.g., three rings) arranged within one another, wherein the frames include substantially straight parallel leg sections that connect to the leg sections of the adjacent frames to define shared core legs and a triangularly shaped set of yokes defining the top and bottom of the core. Thus the core configuration may include three legs located at each of three corners of a triangle and extending perpendicular to the plane of the triangle, as well as three top yokes arranged in the form of a triangle and three bottom yokes arranged in the form of a triangle. By using three rings or loops for each frame and connecting each frame to similar frames on either side, each common leg may be arranged to have a substantially hexagonal cross section as proposed by the hexaformer core configuration (discussed below). The layers of each loop are typically off-set relative to each other to define a loop or ring with a frusto-conical shape when viewed from the side, and the rings or loops forming a frame are placed within one another in an angled configuration (with the rotational axes to define the frame. Multiple rings may instead be wound on top of one another about a common rotational axis to define a frame that is combinable with another, similar frame to define a substantially circular cross-sectional core leg, wherein at least some of the rings include amorphous metal to define amorphous metal rings or partially amorphous metal rings.

Further, according to the invention there is provided a method of improving the efficiency of continuous flux path transformer cores, comprising forming three frames, each made from three or more coils or loops made at least partially from amorphous metal, shaping the frames to define leg sections and yokes, and connecting the frames to adjacent frames by connecting the legs of the frames.

By making use of substantially circular cross-sectional core legs that permit winding on the leg and thus avoid cutting of the core to land the coils on the amorphous or partially amorphous core legs, the present invention provides for a core and transformer construction process that makes an annealing step less critical, and optionally allows annealing to be avoided. In the case of a thermally cured resin the heat for the resin curing may be provided as external heat e.g., in the form of a convection or infra-red oven. For purposes of this application the terms resin and polymer will be used interchangeably.

Further, according to the invention there is provided a method of making a three phase transformer with an amorphous metal core or hybrid core comprising forming an amorphous metal transformer core with three legs, and winding at least one transformer winding onto the core using a winding tube, thereby avoiding having to cut the core in order to receive the winding.

Still further, according to the invention, there is provided a method of making an amorphous metal transformer core with a continuous flux path configuration, e.g., hexaformer configuration, wherein the core is made of three frames, each made of at least three rings, at least one of the rings being composed at least partially of multiple layers of amorphous metal, comprising securing the multiple layers of amorphous metal relative to each other to avoid them slipping relative to each other. Typically the amorphous metal layers are wound onto a winding head from an amorphous metal reel. The securing of the amorphous metal layers relative to each other may comprise providing an internal skeleton, e.g., one or more groups of silicon steel layers that are included in each of the loops or rings to provide greater rigidity to the rings. The securing may instead or in addition include providing resin between the layers. The resin may be sprayed onto the layers from spray heads as the amorphous metal is wound to define a loop. The resin may take the form of a powder or small liquid particles, which may be electrostatically charged and electrostatically applied to one or both sides of the amorphous metal layers.

In addition to the resin between the layers, or instead of the resin between the layers, the core may be provided with an external skeleton. The external skeleton may take the form of a varnish coating. In the case of varnishing of the core, a bake-dip-bake process may be included in the treating of the core to get rid of moisture and enhance penetration of varnish into in the core by promoting the flow of varnish.

Also, in addition to the resin between the layers or instead of the resin between the layers, the core may be covered with a resin layer, by applying resin to the outer surface of the core to define an external skeleton. The application of the resin may be achieved by immersing the core in a bath of resin or by spraying or brushing the resin onto the core. The resin applied between the layers of amorphous metal or to the outer surface of the core may be an ultra-violet light sensitive resin or a thermally curable resin or a two part resin making use of a catalyst in order to cure to B-stage or A-stage.

Since amorphous metal strips are typically of limited width, the present invention provides a method of forming a transformer core that is wider than the width of a single amorphous metal strip. According to the invention there is provided a method of forming an amorphous metal transformer core comprising winding two or more amorphous metal strips next to each other, preferably simultaneously and preferably onto the same winding head, to define a wide combination loop, and securing the amorphous metal windings to each other and the amorphous metal layers relative to each other by including one or more sets or groups of silicon steel layers in the loop, wherein the one or more groups of silicon steel layers are formed from a silicon steel strip that has a width corresponding to the combined width of the two or more amorphous metal strips.

DETAILED DESCRIPTION OF THE INVENTION

The present invention includes the production of any continuous flux path amorphous metal three phase transformers. As defined above for purposes of this application, a continuous flux path core comprises a core that does not involve breaks in the core layers or require cutting of the core layers, in order to place (land) the cores on the leg of the core. This therefore requires winding the transformer coils onto the core legs. As discussed above, this can be achieved either by the use of a bobbin passed through the window of the transformer core or by using a winding tube. The use of a bobbin is very limited by design constraints since it requires enough window space to allow the bobbin to pass through the window even when the other legs are already wound with coils and thus have the effect of reducing the window size.

Figure 1:
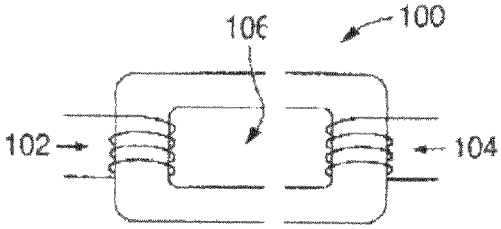
FIG 1 (PRIOR ART)
FIG. 1 shows a prior art toroidal core transformer.
Figure 2:
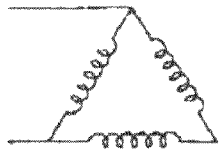
FIG. 2 (PRIOR ART)
FIG. 2 is a representation of a delta connection.
Figure 3:
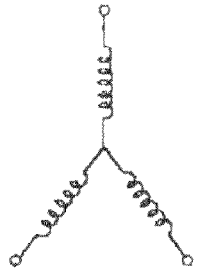
FIG. 3 (PRIOR ART)
FIG. 3 is a representation of a wye connection.
Figure 4:
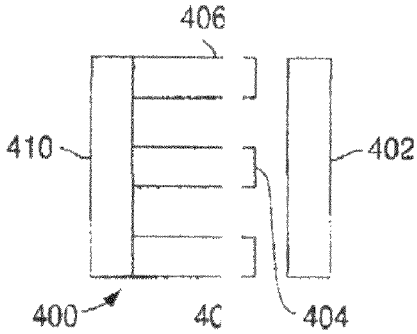
FIG 4 (PRIOR ART)
FIG. 4 is a three dimensional view of a prior art E-core.
Figure 5:
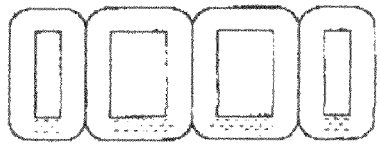
FIG. 5 (PRIOR ART)
FIG. 5 shows a prior art amorphous three phase core.
Figure 6:
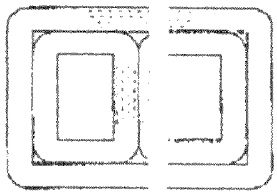
FIG 6 (PRIOR ART)
FIG. 6 shows another prior art three phase amorphous core.
Figure 9:
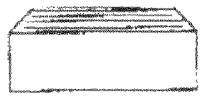
FIG. 9 (PRIOR ART)
FIG. 9 is a side view of a coil or loop of a hexaformer configuration core.
Figure 7:
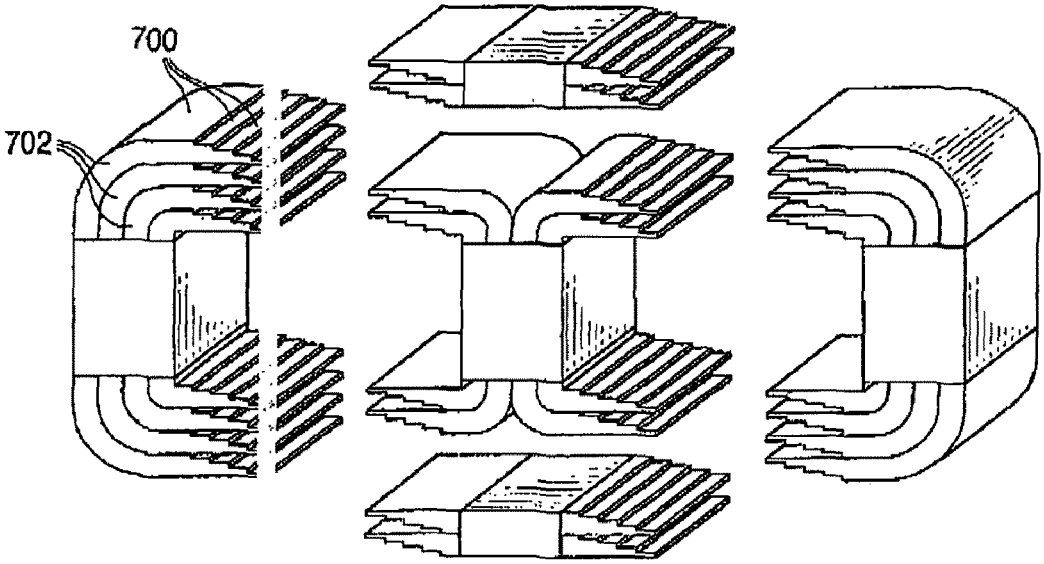
FIG. 7 (PRIOR ART)
FIG. 7 shows a three dimensional view of yet another prior art three phase amorphous core in unassembled state.
Figure 8:
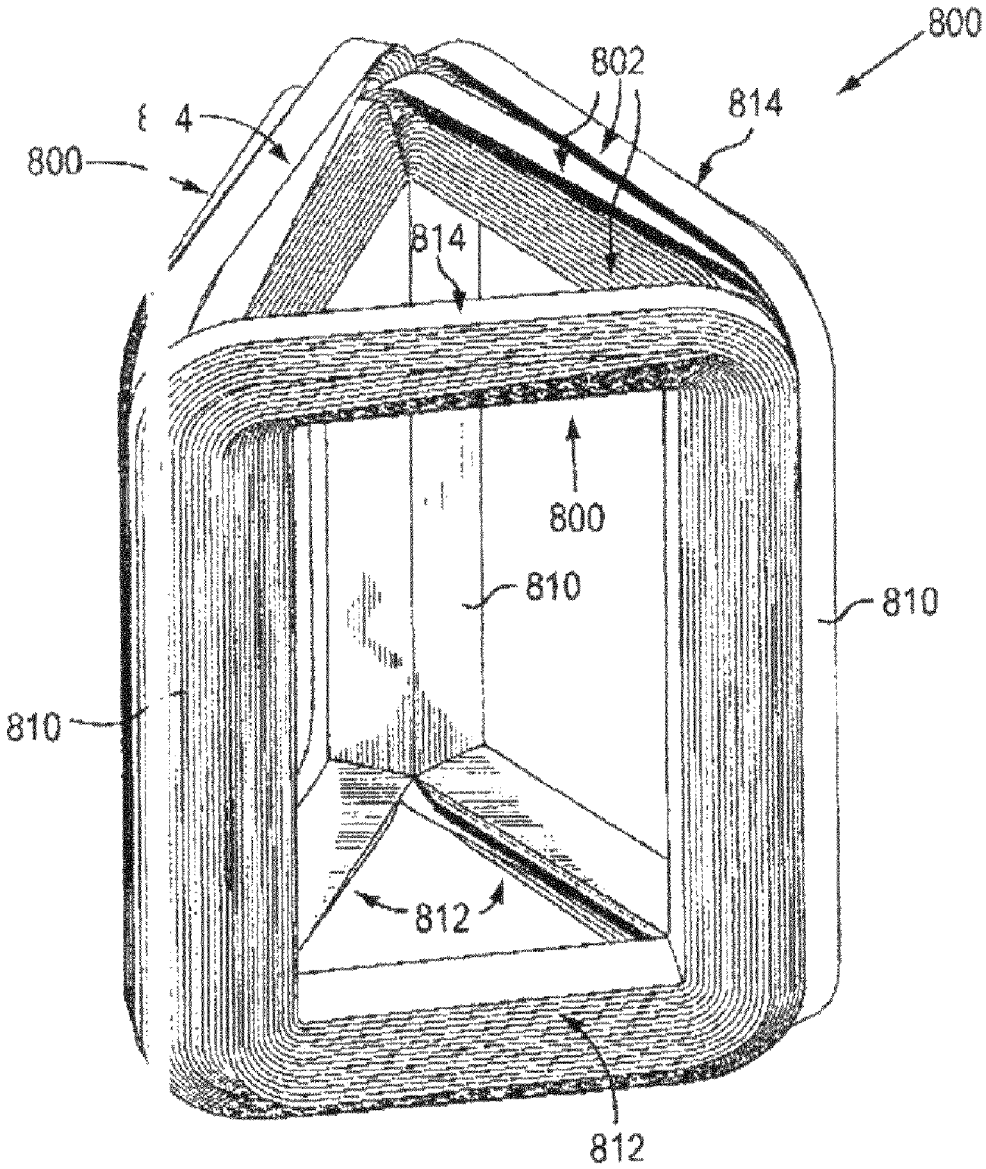
FIG. 8 (PRIOR ART)
FIG. 8 shows a three dimensional view of a prior art hexaformer configuration core.

The alternative, and the one that will be adopted by the present invention is the use of winding tubes that are attached around the legs in a rotatable fashion and thus allow coils to be wound onto the legs by rotating the tubes. This, however, requires leg cross-sections that have a substantially round cross-section in order to minimize the air gap between the core legs and the coil windings (maximize the fill factor). One such three phase, continuous flux path core is the hexaformer core, which comprises three frames 800, each made up of three metal rings, coils or loops 802, the loops or coils 802 being pivoted relative to each other, and each coil 802 comprising multiple metal layers, the layers being off-set relative to each other to define a beveled surface, each ring or coil thereby having a frusto-conical configuration when viewed from the side as shown in FIG. 9. For purposes of this application, the rings, coils or loops of the core will be referred to as rings. By having the three rings arranged inside one another and angled or pivoted relative to each other, the resultant frame 800 can be deformed to define two substantially parallel sides, and forced into engagement with the other frames 800 to define three vertically extending legs 810 located at the corners of a triangle and extending substantially perpendicular to the plane of the triangle, and defining top and bottom yokes 812, 814 connecting the upper and lower ends of the legs 810. As is evident from FIG. 8, the two sets of yokes at the top and bottom have a substantially triangular shape. The particular configuration shown in FIG. 8, involving 3 loops per frame 800 results in core legs 810 having a substantially hexagonal cross section. It will therefore be appreciated that each frame 800 defines a top and a bottom yoke and two half-legs so as to form completed legs when connected to adjacent frames in three dimensional fashion, and provides a continuous flux path. The structure and some of the benefits of the above configuration are discussed in the reference "Comparison between hexa- and conventional E-type core three-phase transformers" by Sonja Lundmark. of Energy and Environment, Chalmers University of Technology, Division of Electric Power Engineering, Yuriy V. Serdyuk, and Stanislaw M. Gubanski of Dept. of Materials and Manufacturing Technology, Div. of High Voltage Engineering, Chalmers University of Technology, and Benny Lärking of Hexaformer Production AB, Västervik, Sweden, which is included herein by reference.

The present invention also applies to other three phase continuous flux path core configurations, including cores in which the rings in a frame share a common rotational axis instead of being angled relative to each other as in the Hexaformer core.

In accordance with the invention, the present applicant provides a new amorphous three phase transformer by providing a method of forming amorphous metal strips into a continuous flux path core configuration. As one aspect of the invention, the amorphous metal layers are secured together to avoid them slipping relative to each other. The amorphous metal is also provided with an internal or external skeleton to give the structure greater rigidity, or both an internal and an external skeleton. Another aspect of the invention involves a process of making amorphous metal transformers without necessarily requiring an annealing step by providing a core with substantially circular cross-sectional legs, and winding conductor coils onto the legs using a winding tube, thereby avoiding excessive damage to the core layers through cutting of the core. For purposes of this application, a substantially circular cross section includes any multi-faceted shape having more than 4 sides. Eliminating annealing gets rid of an important, time consuming and costly step that has typically been a requirement of amorphous metal transformers in the past.

In accordance with the invention, one embodiment for a three phase transformer involves making use of a hexaformer configuration, which includes winding the amorphous metal into sets of three rings, each set being arranged to define a frame and using three frames connected together in a three-dimensional configuration to define hexagonal cross-sectional legs. In order to wind conductive windings onto the core, the present invention makes use of winding tubes that are clamped over each of the legs and rotated relative to the legs during the coil winding process, whereafter the winding tubes are optionally secured relative to the legs and form part of the completed transformer. The present invention thereby avoids the problems associated with the Ngo three phase core and those provided by Metglas and Cogent Power, which, in order to place windings on the core legs require hundreds and even thousands of cuts or breaks in the amorphous metal strip making up the core. By avoiding having to cut the amorphous metal as in the prior art amorphous metal cores of Metglas, Cogent Power, and Ngo, core losses can be reduced substantially and a transformer manufacturing process can be provided that avoids annealing of the core.

Figure 10:
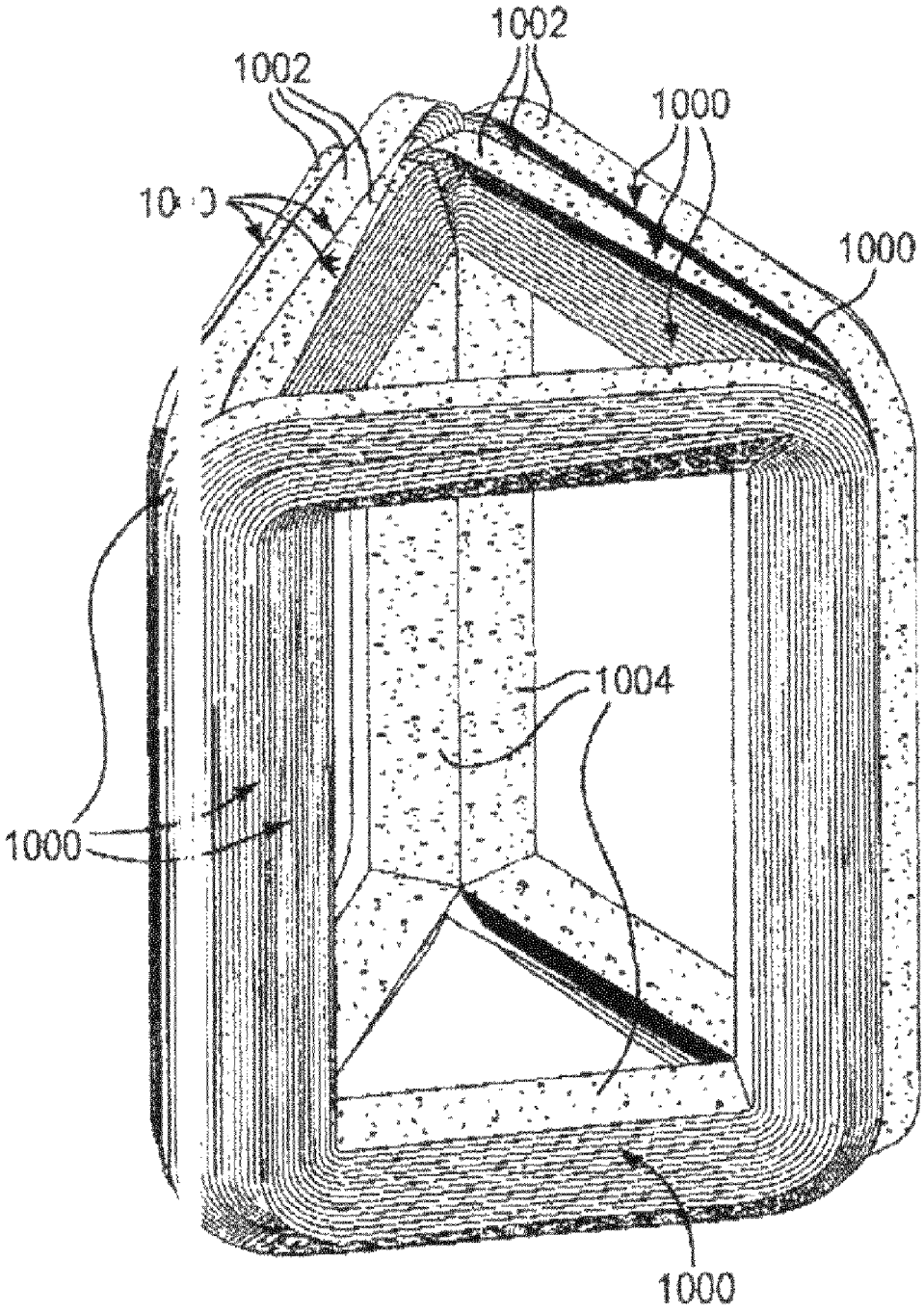
FIG. 10 is a three dimensional view of one embodiment of a three phase amorphous metal transformer core of the invention.

One embodiment of an amorphous metal three phase transformer of the invention is shown in FIG. 10. As discussed above, the amorphous metal strip used to form each of the rings or loops 1000 is about 8 to 12 times thinner than silicon steel and is highly slippery and floppy. For each ring 1000, in order to secure the various amorphous metal layers relative to each other, the present invention therefore provides one or more layers of silicon steel 1002, which in this embodiment are defined by two layers of non-grain oriented silicon steel, which also serve to provide the ring with greater rigidity. The present invention also proposes in one embodiment to provide an inner support in the form of one or more layers of silicon steel prior to winding the amorphous metal layers on top. In this embodiment two layers of non-grain oriented silicon steel 1004 is used on the inner side of each loop 1000. The inner and outer layers of silicon steel thus define an internal skeleton for the amorphous ring.

In another embodiment additional layers of non-grain oriented silicon steel are interspersed between layers of amorphous metal, to provide additional structural integrity. For instance, in one embodiment a double layer of non-grain oriented steel was introduced after winding about one third of the amorphous metal layers, and a further double layer of non-grain oriented steel was introduced after another third of the amorphous metal layers had been wound. In addition inner and outer double layers of non-grain oriented steel were included to provide a total of 4 double layers of non-grain oriented silicon steel. It will be appreciated that additional or fewer than 4 sets of silicon steel support layers can be used for the internal skeleton, and that other materials could be used to form the internal skeleton. Also, while each set of silicon steel layers in the above embodiments included only two layers, it will be appreciated that more than 2 layers could be used. In some embodiments in which silicon steel layers were used for the inner layers, the silicon steel layers were made more rigid by dipping them in varnish and baking them before winding the amorphous metal on them.

Figure 16:
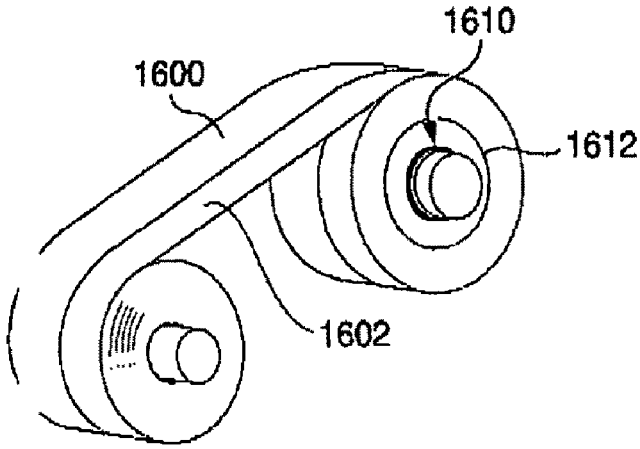
FIG. 16 is a three dimensional depiction of an amorphous metal loop manufacturing method of the invention.

Another difficulty presented by the use of amorphous metal in transformer cores is the fact that amorphous metal strips are typically produced in limited widths. The present invention provides a method of forming a transformer core that is wider than the width of an amorphous metal strip. In the embodiment shown in FIG. 16 an amorphous metal hexaformer configuration core is made that includes loops that are wider than the width of an amorphous metal strip. In this embodiment two amorphous metal strips 1600, 1602 are wound next to each other onto a common winding head. Since the combined loop width in this embodiment was required to be more than the width of a single strip but less than two strip widths, a full strip width was used for strip 1600, while a second strip was slit lengthwise to the desired width to provide loop 2002 having a width that, when combined with the strip 1600 provided the desired total loop width. In order to secure the amorphous metal windings to each other and the amorphous metal layers relative to each other, three sets or groups of silicon steel layers, each set comprising two layers, were included in the winding of the loop. In FIG. 16 only an inner 1610 and a middle set 1612 of silicon steel layers is shown, the outer layer still having to be wound. The silicon steel layers 1610, 1612 have a width corresponding to the combined width of the amorphous metal layers strips 1600, 1602 and thus help to hold the two adjacent amorphous metal loops together. In this way the present invention allows amorphous loops for hexaformer and other continuous flux path configuration cores to be made to any width by providing the desired number of amorphous metal loops next to each other and securing them by including silicon steel layers having a width corresponding to the combined width of the multiple amorphous metal loops. While the above embodiment wound the amorphous metal loops 1600, 1602 next to each other on a common winding head, the loops could be formed separately and then combined using an outer set of amorphous metal layers.

Figure 17:
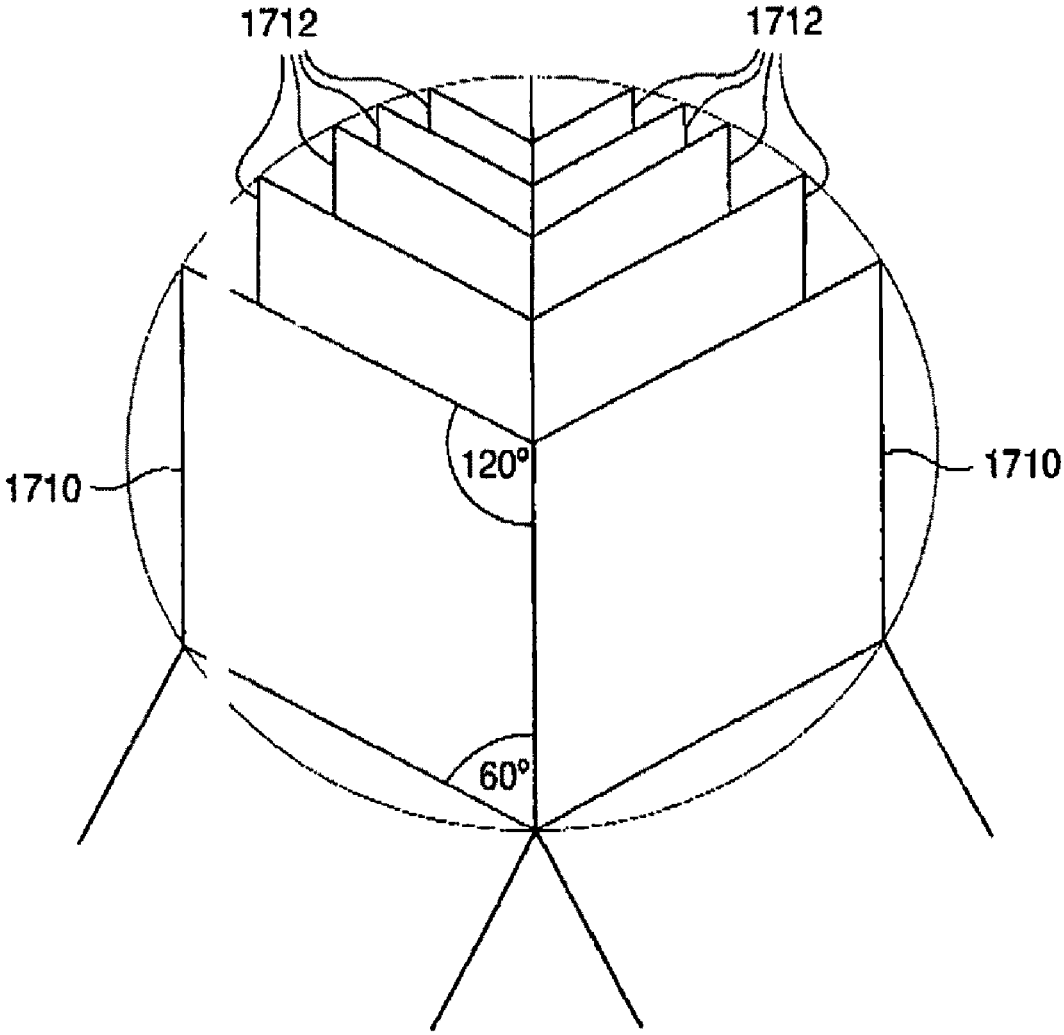
FIG. 17 is a sectional view through two adjacent leg sections of another type of three phase continuous flux path core.

Another three phase continuous flux path transformer core implemented using amorphous material, is shown in FIG. 17. The core shown in FIG. 17 looks similar to the hexaformer and Manderson core configurations in that it provides three frames each made of multiple rings that are connected along leg sections to define core legs arranged at the corners of a triangle, and each with a substantially hexagonal cross-section.

However, unlike Manderson the core of the present invention avoids the use of a tapered magnetic strip by making use of multiple wound rings wound at an off-set to define multiple tapered rings. As shown in FIG. 17, the frames making up the core of the present invention each include a primary inner ring 1710 and multiple secondary rings 1712. The present invention also avoids the use of frames made up of multiple rings that are angled relative to each other as in the hexaformer configuration. In contrast, the present invention has all of the rings in a frame wound on top of one another and sharing a common rotational axis. At least one of the rings may be formed partially or entirely of amorphous metal. In the embodiment of FIG. 17 the inner ring 1710 is made of amorphous metal.

Thus the frames, are each made of a first or innermost ring 1710 that is wound from amorphous metal in off-set fashion to define a parallelogram cross-sectional shape with inside angles of 60 degrees and 120 degrees. Each frame further includes four additional rings 1712 in this embodiment that are also wound in off-set fashion, each such additional ring being off-set in the same direction as the innermost ring 1710. In this embodiment, two of the additional rings are also wound using amorphous metal. It will be appreciated that the innermost ring fills part of a hexagon. The subsequent or additional rings in this embodiment are chosen to fill (together with the innermost ring) a substantial portion of one half of the circumscribed circle, to achieve leg sections that when combined with adjacent leg sections provide core legs with a fill factor that is better than that of legs with a hexagonal cross-section.

Figure 11:
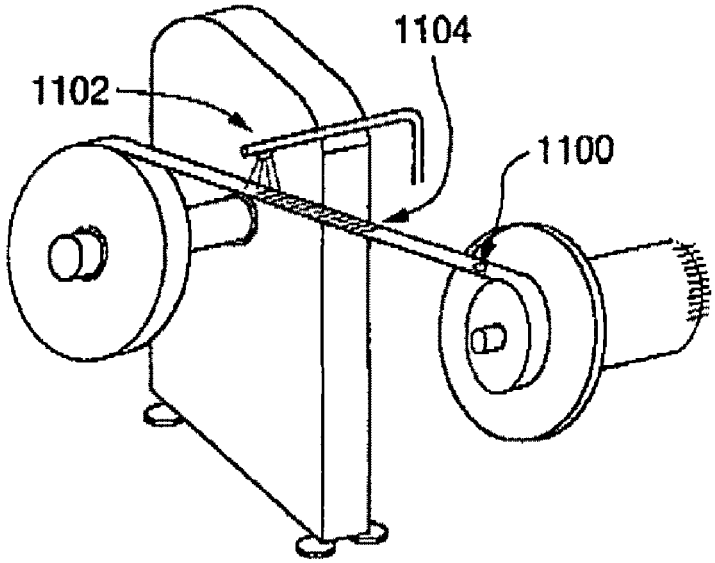
FIG. 11 shows one embodiment of forming wound loops for an amorphous metal continuous flux path core in accordance with the invention.

In another embodiment, shown in FIG. 11, instead of providing structural silicon steel layers to hold the amorphous metal layers together, a resin is sprayed onto the surface of the metal strip as it is wound, thereby providing a resin between the layers and binding adjacent strips to each other. In the present embodiment one or more spots of resin 1100 are applied during each rotation of the winding process, however the spray nozzles 1102 applying the resin in this embodiment, can instead be arranged to continuously apply a film of resin onto the surface of the amorphous metal strip as it is wound and as is depicted by the illustrative example indicated by reference numeral 1104. The resin can be applied in mist (small liquid droplet) form or powder form and can be electrostatically applied to the amorphous metal layers. Insofar as the resin between the layers is cured by ultra violet light in the case of a UV curable resin, the resin is chosen to cure only to B-stage initially, thereby allowing subsequent deformation of the ring, as will become clearer from the discussion below. If the resin is a two part resin that cures at room temperature, the resin or amount of hardener (catalyst) is chosen to provide a long enough cure time to allow the rings to be combined into frames and the frames to be deformed.

Figure 12:
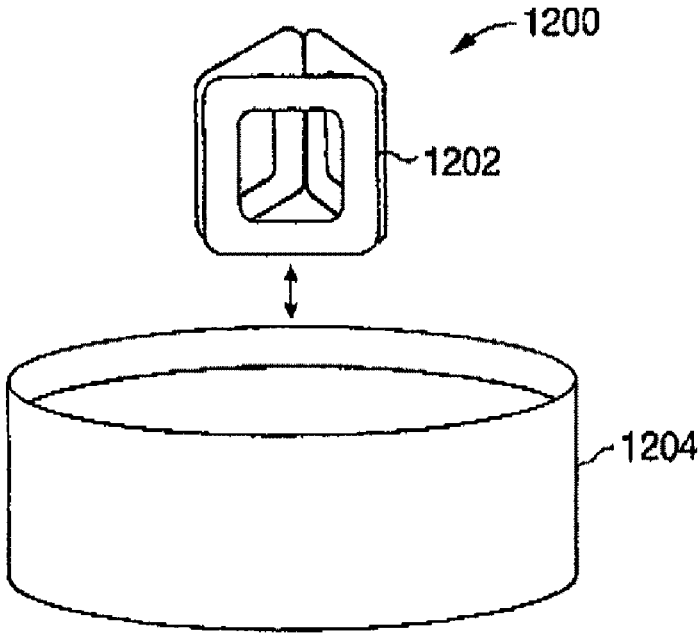
FIG. 12 shows another embodiment of forming an amorphous metal continuous flux path core in accordance with the invention.
Figure 13:
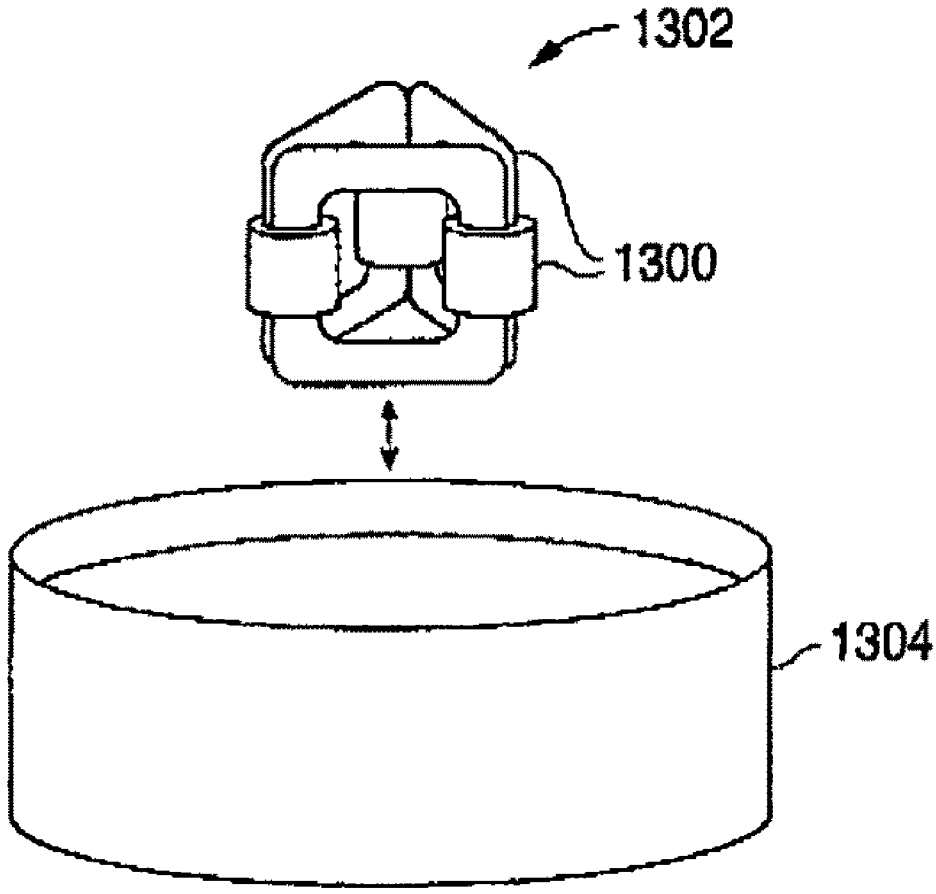
FIG. 13 shows a three dimensional view of a varnish application station for a transformer in accordance with the invention.

In yet another embodiment, shown in FIG. 12, a coating is applied to the outside of the completed core 1200 to define an encapsulating layer 1202 that holds the amorphous layers together and keeps them from slipping relative to each other. The encapsulating layer may be applied without first applying resin spots 1100 or resin film 1104 to the surface of the amorphous metal layers or in addition to such resin 1100, 1104. Similarly the encapsulating layer 1202 could be provided in addition to silicon steel layers 1002, 1004. In the embodiment of FIG. 12, the encapsulating layer 1202 took the form of either a varnish or a resin that was applied before the copper windings of the transformer were applied to the legs. In the case of varnish a bake-dip-bake sequence was used in which the core was heated up to about 200 degrees C., whereafter the core was immersed in a container 1204 containing varnish and then baked again to harden the varnish. In another embodiment a resin coating was applied to the core by filling the container 1204 with resin and immersing the core in the resin or by applying the resin using a brush or by spraying it on using a spray nozzle. In the case of a resin coating an ultra-violet curable resin or two part resin could be used instead of a thermal resin thereby avoiding having to bake the core in order to cure the resin. In another embodiment a resin was applied to the core in addition to the varnishing process by applying the resin after the core has been subjected to a bake-dip-bake process. As will become clearer from the discussion of the assembly process shown in FIG. 14, one embodiment, which is shown in FIG. 13 involves again applying a coating, e.g. a varnish coating, after applying the conductor windings of the transformer, by immersing the transformer in a varnish bath 1304 or by spraying or brushing the varnish onto the transformer.

Figure 14:
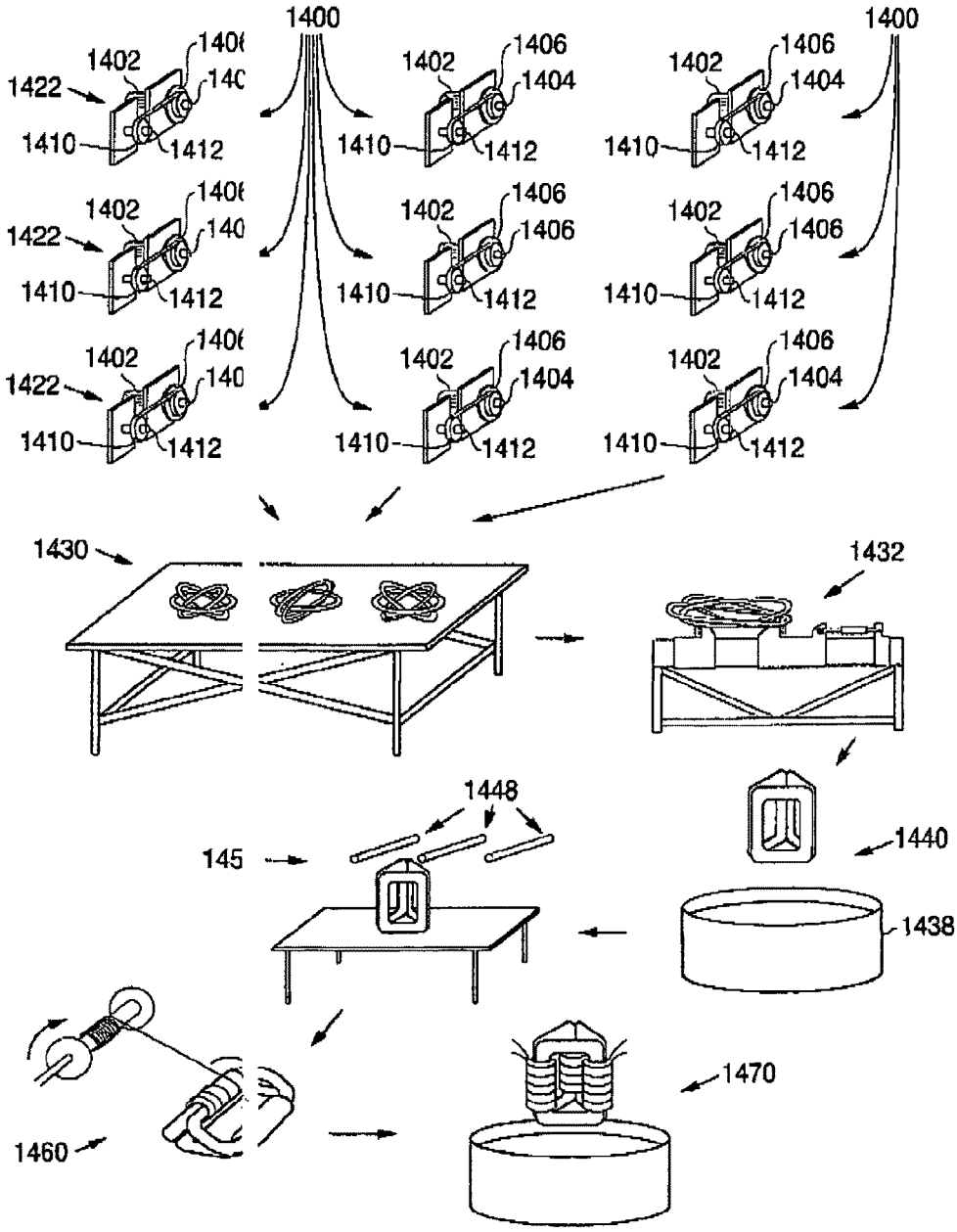
FIG. 14 shows a depiction of one embodiment of a process for forming an amorphous metal transformer having a hexaformer configuration.

One embodiment of a process for the manufacture of an amorphous metal three phase transformer with a hexaformer configuration in accordance with the invention is depicted in FIG. 14. In this embodiment, nine core winders 1400 are used to wind the nine amorphous metal coils or loops used to make the amorphous metal core with the hexaformer configuration in accordance with the invention. Each core winder 1400 includes an electric motor 1402 that drives a head 1404. A guide plate 1406 is mounted on a common shaft with the head 1404 to support the amorphous metal layers and any silicon steel layers as they are wound onto the head. According to one embodiment of the invention discussed above, two layers of non-grain oriented steel are wound onto each of the heads 1404 from a reel 1410 that is mounted on a rotatable spool head 1412 having radially moveable calipers for gripping the reel once it is positioned onto the head 1412. In this embodiment, reels of amorphous metal are thereafter mounted on the spool heads 1412 and amorphous metal layers are wound on top of the two layers of non grain oriented silicon steel. Thereafter two further layers of non-grain oriented silicon steel are wound on top of the amorphous metal layers from reels of non-grain oriented silicon steel mounted on the spool heads 1412 to complete the nine loops or coils. In accordance with the hexaformer configuration the inner sets of loops formed on the three inner winders 1422 are formed from metal strips that are twice as wide as for the middle and outer loops. In order to provide three loops for each frame wherein the three loops fit inside one another as required by the hexaformer configuration, the inner loop is formed on a smaller diameter spool head to provide a smaller coil or loop than the middle and outer loops, while the outer loop is the largest and is wound on the largest spool head. As depicted by the station 1430, the three frames are then formed by placing an outer loop over an inner loop, and placing a middle loop at an angle to the inner loop, and repeating this for each of the three frames that will make up the core. The loops for each frame are then temporarily clamped together to retain the position of the rings relative to each other pending the deformation of the frame as is discussed below.

Figure 15:
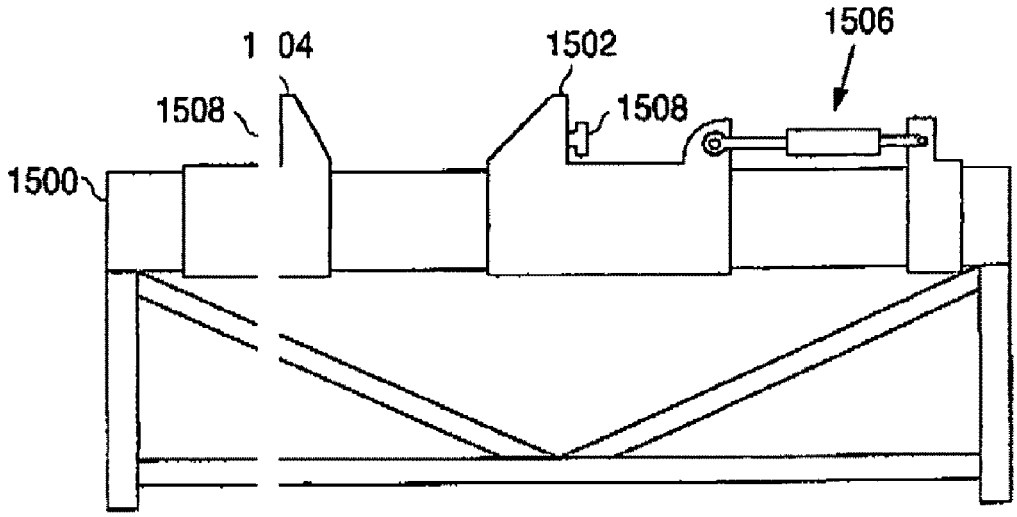
FIG. 15 shows one embodiment of a frame stretching station of the invention.

The frames are deformed by taking the frames to a frame stretching station 1432, which is shown in greater detail in FIG. 15. The stretching station allows appropriately sized press heads to be placed inside the window of the frame and moved outwardly to deform the frame. This deforming step serves the dual purpose of creating a frame with substantially straight parallel leg sections and helps in securing the loops relative to each other. The frames are then connected and clamped to each other. As discussed above, the frames can be secured to each other by means of varnish during a bake-dip-bake stage or by providing a resin coating that acts as an outer skeleton, or by both a varnish and a subsequent resin coating. The legs of the core can alternatively or additionally be secured to each other by means of resin impregnated banding material, also referred to as stator banding in which the resin has typically been cured to B-stage to leave the banding flexible. Once the stator banding has been wound around the legs it is heated to cure it to its final or A-stage.

As shown in FIG. 15, the stretching station includes a frame 1500 that slidably supports two press head mounts 1502, 1504. The mount 1502 is connected to a pneumatic piston 1506, while the mount 1504 is slidably adjustable relative to mount 1502 to accommodate different size frame windows, and can be locked into place. Appropriately sized press heads 1508 are mounted on the mounts 1502, 1504 to engage opposite inner surfaces of the frame that is to be stretched. The mount 1502 is then pneumatically moved outwardly to deform the frame to its desired shape.

In the process described above, the rings were wound onto round winding heads and subsequently deformed. This has the advantage that the winder can be rotated more quickly than in the case of a non-circular winding head.

Once each of the frames has been deformed and the temporary clamps removed, the frames straight sides of the frames are joined together to define three substantially hexagonal cross-sectional legs.

In one embodiment the straight legs are secured to each other by using clamps or braces or ties or tape. Thereafter the present embodiment provides for an encapsulating resin that is painted or sprayed onto the core or is applied by submerging the core in a container of resin 1438 as depicted by reference numeral 1440. In this embodiment fiberglass material in the form of fiberglass chop is included in the resin. As mentioned above, in one embodiment a thermal resin is used for the outer coating, which is baked and acts partially as an annealing step. By avoiding a core configuration that requires cutting the core or breaks in the core in order to land the coils, annealing of the amorphous metal is largely superfluous. However, in one embodiment an annealing step is introduced in order to improve losses. As mentioned above, the use of thermally cured resin that requires baking in order to cure the resin, could therefore in future allow the curing step to be combined with an anneal of the material provided a resin is used having a curing temperature that approaches the effective annealing temperature of amorphous metal (about 300 degrees C.). In the present embodiment, however, an ultraviolet light curable resin is used, which is cured using UV lights 1448 as depicted by station 1450. This saves time since the UV curing process is faster and it also avoids the need for costly and high energy consuming ovens. Once the resin is cured coil tubes are applied to the legs of the core, and the conductor coils wound onto the tubes as is discussed above, and as is depicted here by winding station 1460. The secondary winding may first be wound onto the winding tube, whereafter the primary winding is wound on top of the secondary winding. In another embodiment, the secondary winding is wound on top of the primary winding. This process is repeated for each leg in turn. In this embodiment the resulting transformer is dipped into a varnish bath at station 1470. The varnish from this coating is then baked.

While the present application describes specific embodiments, it will be appreciated that the various aspects of the invention can be implemented in different ways without departing from the principles described in this specification.

What is claimed is:

1. A three phase transformer core, comprising a wound cage core configuration that includes three frames, each frame including multiple rings and defining two substantially parallel leg sections, a first complete end yoke extending continuously to the two leg sections, and a second complete end yoke extending continuously to the two leg sections, the frames being arranged with each leg section of each frame abutting a leg section of an adjacent frame to define a common leg, thereby forming a cage core configuration with three substantially parallel legs arranged parallel to each other to define a first and a second triangular yoke arrangement, wherein at least one of the rings in each frame includes supple amorphous metal strips material, the rings are non-interleaved, and the core includes at least one of an internal, and an external polymer skeleton.

2. The core of claim 1, wherein the core is formed partly from amorphous metal and partly from silicon steel.

3. The core of claim 2, wherein at least some of the rings in each frame include supple amorphous metal strips material and the rings that include amorphous metal strips material comprise multiple inner layers of silicon steel and multiple outer layers of silicon steel, the inner and outer layers sandwiching multiple layers of amorphous metal strips material between them.

4. The core of claim 1, wherein at least some of the rings include multiple inner layers of silicon steel that has been treated with a rigidity enhancing coating to define an inner support tube for the amorphous metal strips material layers to define an internal polymer skeleton.

5. The core of claim 1, wherein the core includes multiple layers of supple amorphous metal strips material, at least some of which are secured relative to each other by a resin to define an internal polymer skeleton.

6. The core of claim 5, wherein the resin forms a substantially constant layer between the layers of amorphous metal.

7. The core of claim 1, wherein the external polymer skeleton includes resin applied to the outer surface of at least part of the legs and yokes.

8. The core of claim 7, wherein the layers of wound material in each of the rings are off-set relative to each other to define a ring with a frusto-conical shape when viewed from the side, and the rings of each frame are placed at least partially within one another in an angled configuration, with the rotational axis of at least one of the rings in each frame being angled relative to the rotational axes of the other rings in the frame.

9. The core of claim 7, wherein each of the multiple rings in a frame shares a common rotational axis.

* * * * *